United States Patent [19]

Kelly

[11] Patent Number: 4,761,981

[45] Date of Patent: Aug. 9, 1988

[54] SWAGING APPARATUS FOR FLARING AND ANCHORING TUBES

[75] Inventor: John W. Kelly, Burbank, Calif.

[73] Assignee: Haskel, Inc., Burbank, Calif.

[21] Appl. No.: 29,320

[22] Filed: Mar. 23, 1987

[51] Int. Cl.[4] ..... B21D 22/00

[52] U.S. Cl. ..... 72/58; 72/62; 72/393; 29/237; 29/157.4; 29/421.1

[58] Field of Search ..... 72/58, 57, 60, 61, 62, 72/63, 317, 370, 393; 29/727, 237, 252, 254, 421

[56] References Cited

U.S. PATENT DOCUMENTS

| | | | |
|---|---|---|---|
| 3,466,920 | 9/1969 | Parker | 72/393 |
| 4,262,518 | 4/1981 | Creger et al. | 72/393 |
| 4,320,568 | 3/1982 | Herrod et al. | 72/370 |
| 4,359,889 | 11/1982 | Kelly | 72/62 |
| 4,387,507 | 6/1983 | Kelly | 72/58 |
| 4,388,752 | 6/1983 | Vinciguerra . | |
| 4,502,308 | 3/1985 | Kelly | 72/58 |
| 4,513,506 | 4/1985 | Vogeleer | 72/393 |
| 4,567,631 | 2/1986 | Kelly | 72/62 |
| 4,581,817 | 3/1986 | Kelly | 29/727 |
| 4,607,426 | 8/1986 | Kelly | 72/58 |

FOREIGN PATENT DOCUMENTS

| | | |
|---|---|---|
| U7202510 | 1/1978 | Fed. Rep. of Germany . |
| A405210a | 9/1964 | Switzerland . |

*Primary Examiner*—W. Donald Bray

*Attorney, Agent, or Firm*—Pretty, Schroeder, Brueggemann & Clark

[57] ABSTRACT

A swaging mandrel is inserted in a tube confined by a tube sheet or other surrounding structure. A pair of seals define the axial limits of a hydraulic pressure zone within the tube sheet in which radial expansion of the tube takes place in response to fluid pressure. At one side of the tube sheet, an elastomeric ring can extend beyond the tube sheet and, in response to the fluid pressure, produce an attenuated radial expansion force that bulges the tube. At the primary side of the tube sheet, an elastomeric ring, in response to the fluid pressure, causes arcuate segments of a cylinder positioned beyond the tube sheet to expand radially and flare the tube at the opposite side of the tube sheet.

24 Claims, 2 Drawing Sheets

SWAGING APPARATUS FOR FLARING AND ANCHORING TUBES

FIELD OF THE INVENTION

The present invention relates to swaging for radial expansion of tubes, and, more particularly, to the flaring or flaring and bulging of the tube during the swaging process to anchor the tube within a tube sheet or other surrounding structure and preventing leakage.

BACKGROUND OF THE INVENTION

In many situations it is desired to expand a tube radially within a surrounding structure such as a tube sheet, thereby anchoring the tube in the desired position and forming a leak proof joint. One form of swaging used for many years is known as roller swaging. An implement is inserted in the tube and, as it rotates, gradually deforms the tube outwardly. However, roller swaging, while still in common use, is time consuming and is characterized by a tendency to reduce the thickness of the tube wall with accompanying weakening and elongation of the tube.

Preferable swaging techniques are hydraulic. Fluid pressure is applied to the tube internally to produce radial expansion, as described in, for example, U.S. Pat. No. 4,502,308. In other situations, as a preliminary step or where lower pressures are desired, it is preferred to use draw bar swaging in which an elastomeric material is compressed axially, causing it to expand radially within the tube, as described, for example, in U.S. Pat. No. 4,387,507.

By properly swaging a tube, a permanent leak proof joint that will, for example, confine combustion gasses and is not readily subject to corrosion can be formed by eliminating spaces between the tube and the surrounding structure. A positive mechanical interlock can be formed between the tube and the surrounding structure to insure that the tube will not be pulled loose, even if the joint should begin to loosen or leak. The formation of a highly secure mechanical interlock is particularly important in, for example, the boiler of a ship in which many tubes pass through tube sheets that form boiler walls.

The creation of a highly secure mechanical interlock between the tube and the tube sheet may be even more important, in some situations, than the prevention of leakage because a tube that breaks loose from the tube sheet could discharge steam into an area where personnel are present. One common technique for insuring a reliable tube securement is to cause the tube end to be flared or belled at the primary side of the tube sheet to prevent the tube from moving toward the secondary side. This flair provides a positive visually verifiable mechanical interlock and is a standard practice on U.S. Navy ships.

Another common interlock technique is to cause the exposed portion of the tube on the less accessible side of the joint, normally the secondary side of the tube sheet, to bulge or expand permanently to an outside diameter greater than the diameter of the bore in which the tube is located. This bulge prevents the tube from moving toward the primary side of the tube sheet and, like a flared end, provides a positive visually verifiable interlock. This technique is likewise required by the U.S. Navy, which demands a bulge extending $\frac{3}{8}$ inches from the secondary side of the tube sheet.

It should be understood that the portion of the tube supported within the tube sheet or other surrounding structure can withstand internal pressure substantially in excess of that required to burst an unsupported tube. It is a common practice to subject this internal portion of the tube to pressures in excess of its burst pressure during formation of a joint by swaging. The exposed and unsupported portions of the tube extending beyond the faces of the tube sheet that are to be bulged and flared are limited to a significantly lower pressure, although the burst pressure of the exposed tube is significantly increased in areas immediately adjacent to the tube sheet when compared to a totally unsupported tube.

Various difficulties have been encountered in connection with the belling and flaring of tubes using both hydraulic fluid and draw bar apparatus. Some of these difficulties are attributable to the substantial increase in diameter that takes place during belling and bulging, thus making it difficult to maintaining an effective seal against the inside of the tube to confine the hydraulic fluid that applies the swaging forces. Another problem encountered in this respect is damage to the seals and seal-backup components.

An objective of the present invention is to provide an improved swaging technique to produce visually verifiable mechanical interlocking by a swaging method that is more efficient and effective when compared to presently known techniques.

SUMMARY OF THE INVENTION

One aspect of the present invention relates to a hydraulic swaging method, that accomplishes the above objective, for expanding and anchoring a tube within a tube sheet or other surrounding structure to form a joint. First, a tube is inserted in a bore in the surrounding structure such as a tube sheet. A swaging mandrel is then positioned in the tube, thus defining a hydraulic pressure zone axially bound by first and second seal members, such as O-rings. The mandrel is preferably positioned so that the hydraulic pressure zone is entirely within the surrounding structure. An elastomeric member and a plurality of arcuate segments forming a cylinder are disposed adjacent to the second seal member. The segments are at least partially, preferably entirely, disposed outside of the surrounding structure.

A pressurized fluid, which may be at a pressure exceeding the burst pressure of the tube, can be introduced into the hydraulic pressure zone, preferably through the mandrel. The pressure of the fluid causes the tube to expand radially within the hydraulic pressure zone and applies an axial compressive force to the elastomeric member, which in turn exerts a radial expansive force on the tube. The pressure and the resulting axial compressive force causes the segments to move radially outwardly and flare an end portion of the tube as the cylinder is thus expanded, thereby positively interlocking the tube with the structure and also providing visible confirmation of the integrity of the joint. The cylinder prevents excessive or destructive deformation of the elastomeric member.

A conical cam ring can be included to apply radially expansive forces to the cylinder. A preferred material for the elastomeric member is polyurethane. A stop member may be included to engage the surrounding structure and thus position the mandrel.

The apparatus may also include another elastomeric member positioned near the side of the surrounding structure farthest from the expandible cylinder. This member can be located partially within and partially without the surrounding structure from the standpoint of its axial position. The hydraulic pressure causes this elastomeric member to be compressed axially and expanded radially, thereby bulging a portion of the tube adjacent to the surrounding structure. A centering sleeve can be provided to prevent radial shifting of the elastomeric ring to a position that is off-center with respect to the longitudinal axis of the mandrel.

The cylinder can be formed by an array of separate arcuate segments, preferably inelastic steel segments that abut each other before pressure is applied and expansion begins. The segments may be held together by a resilient band. The cam ring and the segments may have mating conical surfaces, preferably intersecting the longitudinal axis of the support at about a 15 degree angle. The exterior surface of the segments may have serrations that grip the inner surface of the tube as flaring takes place.

The apparatus may further include an anvil from which the support extends. The anvil may define a recess in which the cylinder is at least partially disposed, the recess being dimensioned to receive the end portion of the tube to be flared.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENT

Figure 1:
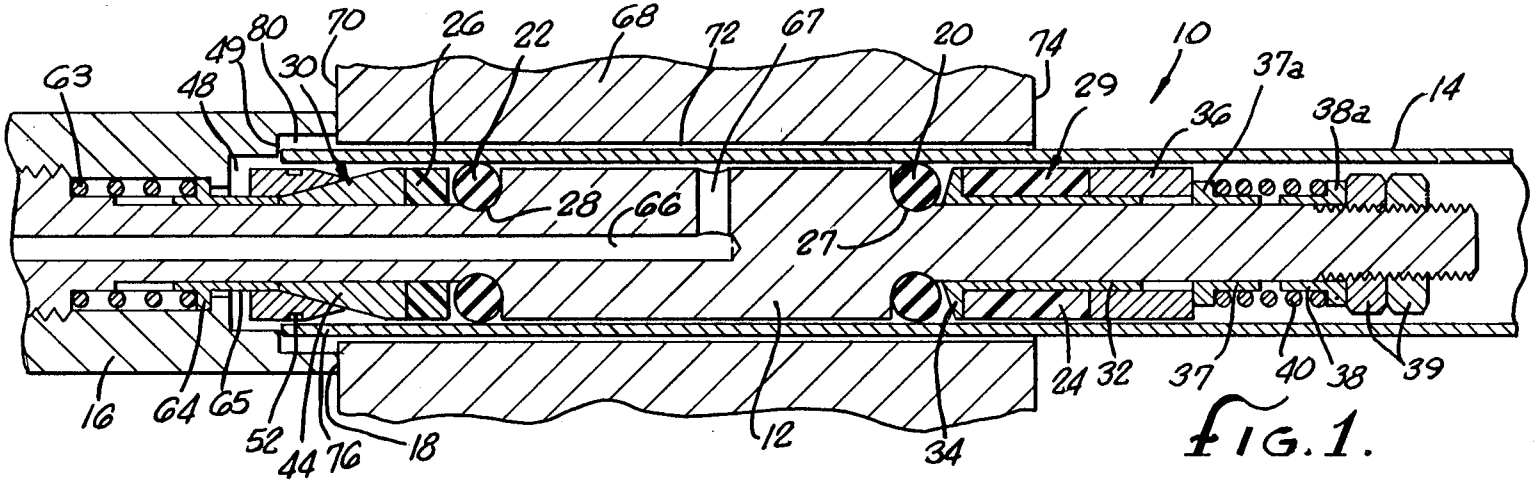
FIG. 1 is a cross-sectional view of a swaging mandrel that is constructed in accordance with the present invention and inserted in a tube which has been positioned in a tube sheet bore prior to the application of swaging pressure, the view being taken along the longitudinal axis of the mandrel and the tube.

A hand held mandrel apparatus 10, suitable for carrying out the method of the present invention and shown in FIG. 1, includes a generally cylindrical elongated steel support 12 suitable for insertion in a tube 14 to be swaged. The support 12 is attached to an anvil 16 provided with a stop surface 18 by which the axial position of the support within the tube 14 is determined, as explained more fully below.

First and second seal members 20 and 22 encircle the support 12, thus defining the ends of an annular hydraulic pressure zone extending axially between the tube 14 and the support. On the side of each seal member 20 or 22, away from the hydraulic pressure zone, is an elastomeric expander ring 24 or 26, respectively, that encircles the support 12. The seal members 20 and 22, typically rubber O-rings, are soft and resilient and make direct contact with pressurized hydraulic fluid, preventing the escape of fluid from the pressure zone. Each of the O-rings 20 and 22 is normally seated in a circumferential groove, 27 or 28, respectively, in the support 12. Preferably, the elastomeric rings 24 and 26 are made of polyurethane, which behaves like a fluid at high pressure to expand the tube radially, but has a memory if its elastic limits are not exceeded.

The seal members 20 and 22 are thus capable of withstanding the high or intermediate pressures (e.g. 20,000 psi) encountered if they are not exposed to any gap or unsupported areas into which they can extrude beyond their elastic limits while the pressure is being applied. Near one end of the support 12, farthest from the anvil 16 (at the right in FIGS. 1 and 2), is the bulging mechanism 29, which enters the tube 14 first. At the other end of the support 12, adjacent to the anvil 16, is the flaring mechanism 30. The hydraulic pressure zone, defined by the seal members 20 and 22, thus lies between the bulging mechanism 28 and the flaring mechanism 30.

The bulging mechanism 29 includes the first elastomeric ring 24, which surrounds and rides on a steel centering sleeve 32. The clearance between the centering sleeve 32 and the support 12 is very small in comparison to the length of the sleeve, so the sleeve cannot be cocked or moved angularly with respect to the support to any significant extent. The elastomeric ring 24 fits tightly on the sleeve 32 and cannot move angularly or radially with respect to the sleeve.

A flange 34 that projects radially outwardly at one end of the sleeve 32 is disposed between the adjacent O-ring 20 and the corresponding elastomeric ring 24. At the opposite end of the elastomeric ring 24 from the O-ring 20 is a first steel spacer ring 36 that limits axial travel of the sleeve 32 along the support 12 away from the hydraulic pressure zone. A second steel spacer ring 37 and a third ring 38, restrained by two nuts 39 threaded to the support 12, axially positions the first spacer ring 36. A seal-return coil spring 40 encircles the second and third sleeves 37 and 38, engaging shoulders **37*a* and 38*a* on the sleeves and urging them apart. The seal return spring thus also tends to urge the associated O-ring 20 toward the groove 27 in which it normally resides once the O-ring has moved axially along the support 12** away from the pressure zone.

Figure 3:
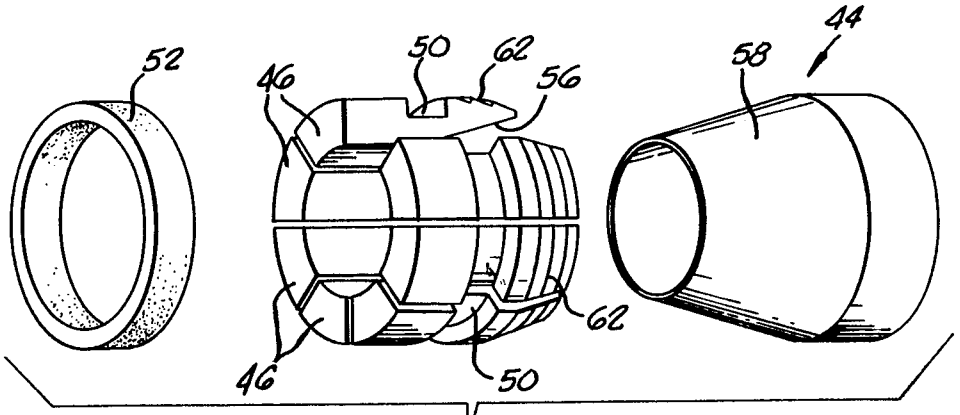
FIG. 3 is an enlarged, exploded pictorial view of the components of the flaring mechanism of FIG. 1.

The flaring mechanism 30 at the opposite end of the pressure zone includes an inelastic steel cam ring 44 directly adjacent to the elastomeric ring 26 and a cylinder formed by a circular array of eight separate arcuate inelastic steel segments 46 (see FIG. 3). The anvil 16 defines a generally cylindrical recess 48 in which the flaring mechanism 30 is partially disposed, the diameter of the recess being large enough to permit radial expansion of the flaring mechanism and the tube 14. The outer end of the recess 48 is enlarged to define an annular internal tube stop shoulder 49 that can be used to position the tube 14 axially.

Preferably, the segments 46 are manufactured by first forming a ring and then cutting the ring longitudinally. The segments 46 are dimensioned so that they fit closely around the support 12 when assembled as a cylinder, the adjacent segments directly abutting each other without gaps between them. The external cylindrical surface of the assembled segments 46 defines a circumferential groove 50 in which a resilient polyurethane band 52 is disposed to urge the segments inwardly against the support 12.

The ends of the segments 46 nearest the elastomeric ring 26 form a conical cam surface 56 that extends radially inwardly as it proceeds toward the anvil 16. Mating with the cam surface 56 and positioned at a complementary angle is a conical spreader surface 58 of the cam ring 44. These exemplary conical surfaces 56 and 58 preferably form an angle of about 15 degrees with the longitudinal axis of the support 12. A larger angle could result in an outwardly directed force that would be too small. The end 60 of each segment 46 nearest the elastomeric ring 26 is blunt to avoid breakage, and the outer surface 62 at the end of each segment is externally chamfered with serrations to grip the tube 14 during flaring. These serrations or teeth, which extend circumferentially around the segments, should not be so sharp as to make disengagement difficult when the mandrel 12 is to be withdrawn.

A cam-return coil spring 63 is positioned within the anvil 16 and bears against a circumferential flange 64 on a cam-return sleeve 65 that is axially slidable on the support 12. The sleeve 65 extends axially through the cylinder formed by the segments 46 and abuts against the cam ring 44. Accordingly, the spring 63 acts through the sleeve 65 to urge the cam ring 44 toward the pressure zone and to urge the O-ring 22 toward the groove 28 in which it normally resides.

A fluid passage 66 extends axially through the support 12 from the anvil end and then radially to an opening 67 on the exterior surface of the support within the hydraulic pressure zone. A pump and pressure intensifier (not shown) are connected to the passage 66 to supply water under pressure to the hydraulic pressure zone.

The operation of the apparatus 10 in accordance with the method of the invention requires that the tube 14 to be swaged be inserted axially in the bore of a surrounding structure, such as the tube sheet 68, shown in FIG. 1. Insertion is made from the primary side 70 of the tube sheet 68. The bore is dimensioned to receive the tube 14 snugly, but a substantial radial clearance 72 between the tube and the tube sheet 68 is necessary so that the tube can be inserted without interference, taking into account the relatively high tolerances normally associated with the outside diameter of the tube.

In general, the tube 14 will extend a considerable distance from the secondary side 74 of the tube sheet 68. A short external end portion 76 extends beyond the primary side 70.

The support 12 and associated components of the mandrel 10 are inserted axially in the tube 14 from the primary side 70 of the tube sheet 68. The anvil 16 is brought forward until the stop surface 18 contacts the primary side 70 and thus properly positions the mandrel 10. The stop surface 18 engages the primary side 70 of the tube sheet 68 with the entire hydraulic pressure zone that extends between the O-rings 20 and 22 located within the tube sheet. The first elastomeric ring 24 is partially located within the tube sheet 68, but extends into the unsupported external portion of the tube 14 that projects from the secondary side 74 of the tube sheet 68.

The external end portion 76 of the tube 14 that extends beyond the primary side 70 of the tube sheet is received by an enlarged portion 80 of the recess 48. The forward portions of the cam ring 44 and the segments 46 that make up part of the flaring mechanism 30 are positioned within the recess 48, while the associated elastomeric ring 26 is located entirely within the tube sheet 68.

Water under pressure is introduced through the passage 66 into the annular volume between the support 12 and the interior surface of the tube 14. The pressure of this fluid can be well above the burst pressure of the tube 14. A typical and exemplary burst pressure might be about 12,000 psi, and a corresponding fluid pressure might be about 20,000 psi. Within the hydraulic pressure zone, the pressure deforms the tube 14 by expanding it radially against the surrounding tube sheet 68.

Upon the application of fluid pressure, an expansive radial force is also exerted on the tube 14 by the first O-ring 20 and by the first elastomeric ring 24. The O-ring 20 moves out of its groove 27 as it slides axially along the support 12, compressing the seal return spring 40. The arcuate surface of the groove 27 acts as a ramp along which the O-ring 20 slides as it expands radially. The O-ring 20 and the elastomeric member 24 tend to expand radially as they are compressed axially between that pressure zone and the spring 40. Since the elastomeric ring 24 extends at least partially ouside the surrounding structure, this radial expansion produces a bulge 82 in the exterior portion of the tube adjacent to the secondary side 74 of the tube sheet that is easily verified by visual inspection (see FIG. 2 in which the radial dimension of the bulge is exaggerated). The centering sleeve 32 keeps the support 12 centered radially within the tube 14, thus minimizing the potential for destructive extrusion of the elastomeric ring 20 by minimizing the largest radial dimension of the circumferential gap formed as the tube expands. The unsupported area of the elastomeric member 24 is thus evenly distributed about its entire circumference, as explained in U.S. Pat. No. 4,359,889 entitled "Self-Centering Seal For Use In Hydraulically Expending Tubes."

However, the outward radial force exerted by the elastomeric ring 24 is less than the fluid pressure, the amount of the reduction being a function of the configuration of the member and the material used, which determine the efficiency of the material. Generally, the efficiency of the elastomeric ring 24 becomes higher as the wall thickness of the member in its relaxed state increases in ratio to the wall thickness at the place of maximum radial expansion. It has been found that, for example, a polyurethane elastomeric member having a relaxed wall thickness of 0.110 inches is suitable for expansion to 0.130 inches.

The radial force exerted by the elastomeric ring 24 also decreases with the distance from the hydraulic pressure zone, approximating a linear function. Care must be taken to position the first O-ring 20 at a sufficient axial distance inwardly from the secondary side 74 of the tube sheet 68 so that the radial forces applied by the elastomeric ring 24 to the unsupported external portion of the tube 14 will not exceed the limits of the tube strength and cause the tube to burst. A portion of the elastomeric ring 24 should be with the tube sheet 68 where radial expansion is very limited, thus preventing extrusion of the O-ring 20. In the accompanying drawings, only a relatively small part of the elastomeric ring 24 is within the tube 68 to attenuate the pressure in the unsupported portion of the tube; but the mandrel apparatus 10 could be dimensioned so as to shift the O-ring 20 to the left (inwardly in FIG. 2) for greater force attenuation, which would be particularly desirable if the hydraulic pressure in the pressure zone were high in ratio to the burst pressure of the tube.

The greatest radial force applied by the first elastomeric member 24 to the unsupported portion of the tube 14 is applied at the secondary surface 74 of the tube sheet 68, since this force decreases axially. It is at this location that the maximum force is desired to insure a tight leak proof joint without crevices that could contribute to the onset of corrosion. A tight joint will be obtained by the method of the present invention even if there is a slight curvature to the secondary surface 74 of the tube sheet 68, making the formation of such a joint along the surface more difficult to achieve.

Figure 2:
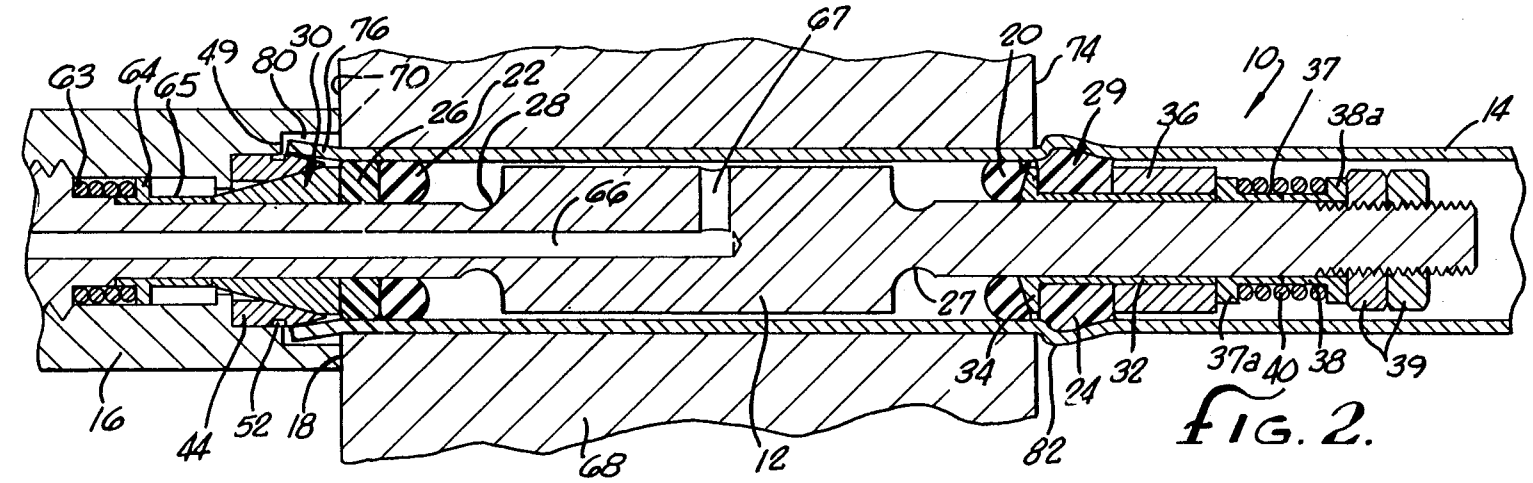
FIG. 2 is a cross-sectional view similar to FIG. 1, but showing the apparatus and its environment after swaging pressure has been applied and the tube has been expanded.
Figure 4:
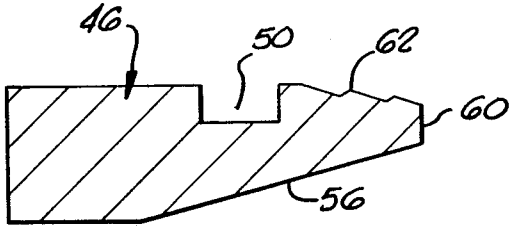
FIG. 4 is a further enlarged cross-sectional view of a fragmentary portion of a segment that forms part of the flaring mechanism shown in FIG. 3.

It should be understood that the ability of the exposed portions of the tube 14 to withstand internal pressure is greatest in the area closest to the tube sheet 68 where the tube has more support. The pressure in this area may substantially exceed the nominal burst pressure of the tube 14. As the distance from the secondary surface 74 increases and the ability of the tube 14 to withstand pressure decreases, the pressure applied by the elastomeric ring 24 also decreases. The bulge 82 of the tube 14 therefore tapers inwardly as it proceeds away from the tube sheet 68, as shown in FIG. 2 (the taper being exaggerated significantly within the tube sheet).

At the end of the hydraulic pressure zone nearest the primary side, an expansive radial force is exerted on the tube 14 by the second or outer O-ring 22 and by the second or outer elastomeric ring 26 due to the fluid pressure. The second elastomeric ring 26 is compressed axially by the force of the fluid pressure acting against the cam-return spring 63 and is thereby expanded radially against the inside of the tube 14, as shown in FIG. 2.

The second elastomeric ring 26 drives the cam ring 44 axially along the support 12 into the cylinder formed by the segments 46 as the spring 63 is compressed. As the cam ring 44 is driven toward the segments 46 of the flaring mechanism 30, the interaction of the conical surfaces 56 and 58 forces the segments to move radially outwardly (see FIG. 2). The resilient band 52 is stretched as the segments 46 move outwardly. It is preferred that the segments 46 retain their cylindrical configuration as they move outwardly, rather than causing the segments to pivot at the ends farthest from the pressure zone. Pivoting would tend to occur if the acute angle formed by the intersection of the conical surfaces 56 and 58 with the longitudinal axis of the support 12 were too large. It is also important that the cam ring 44 extend well into the segments 46 since the axial extension of the segments beyond the end of the cam ring tends to cause pivoting of the segments. The conical surfaces of the segments 46 should also extend into the area surrounded by the resilient band 52 so that the inwardly directed reaction forces will be aligned with the outwardly directed forces of the cam ring 44.

As shown in FIG. 1, each segment 46 is initially disposed within the external portion 76 of the tube 14, preferably contacting only the outer half of the external portion of the tube, close to the open end of the tube. Flaring is limited by contact between the segments 46 and the surrounding portion of the anvil 16 in which they are disposed. Once swaging is completed (FIG. 2), each segment 46 overlaps the cam ring 44 to the maximum extent, reaching close proximity to the second elastomeric ring 26. The radial movement of the segments 46 forces the external portion 76 of the tube 14 to flare, starting at the circumferential boundary where the tube leaves the tube sheet 68.

When it is desired to withdraw the mandrel 10, pressure is no longer applied to the hydraulic fluid and the springs 40 and 63 force the O-rings 20 and 22 to move toward each other and return to their positions in the grooves 27 and 28. With the outside diameter of the O-rings 20 and 22 thus reduced, there is little frictional resistance to the withdrawal of the mandrel 10. The cam-return spring 63 forces the cam ring 44 to move toward the pressure zone and the segments 46 move radially inwardly toward the support 12 under the force of the resilient band 52.

The flaring of the external tube portion 76 forms a highly secure interlock with the tube sheet 68, insuring that the tube cannot be pulled away from the primary side 70 and out of the tube sheet bore. In addition, it insures a particularly strong high pressure seal at the point where the tube 14 leaves the tube sheet 68, thus closing any crevices in that area that might be conducive to the inception of corrosion. High swaging pressure at the primary side 70 of the tube sheet 68 is produced about the entire circumference of the tube 14, even if the tube sheet has a significant curvature.

Whenever an elastomeric material is used, care must be taken not to exceed its elastic limits with resulting plastic deformation, as previously explained. Care should also be taken to insure that the second elastomeric ring 26 does not extend significantly into the external portion 76 of the tube 14. Otherwise the elastomeric ring might expand radially in this region, moving out well beyond the outer diameter of the cam ring 44. The same segments 46 that flare the tube 14, thus serve an important anti-extrusion function by blocking axial extension of the second elastomeric ring 26 into the flared portion of the tube. In many situations it is preferred to follow the above procedure by inserting a second mandrel (not shown) and applying a higher pressure (e.g. 50,000 psi), although this pressure is applied only within the confines of the tube sheet 68.

It should be appreciated that the present invention provides a highly efficient and reliable method and apparatus for swaging that flairs one end of a tube and can bulge the opposite tube extension to produce a tight joint and visually verifiable interlocks. While a particular form of the invention has been illustrated and described, it will be apparent that various modifications can be made without departing from the spirit and scope of the invention.

I claim:

1. An apparatus for expanding and anchoring a tube within a surrounding structure by radially expanding said tube and flaring an end of said tube projecting from said surrounding structure comprising:

an elongated support for insertion in said tube;

positioning means for axially positioning said support with respect to said surrounding structure;

first and second sealing rings encircling said support for engaging the inside surface of said tube and thus defining a hydraulic pressure zone extending axially through a portion of said tube, whereby hydraulic pressure applied within said pressure zone causes radial expansion of said tube; and flaring means for flaring said end of said tube comprising a cylinder formed by a plurality of arcuate segments having cam surfaces thereon, and a cam member disposed between said cylinder and said second sealing ring, whereby hydraulic pressure within said zone causes said cylinder to expand radially in response to axial movement of said cam member, thereby flaring said tube end.

2. The apparatus of claim 1 wherein said cylinder is located with respect to said positioning means so as to be disposed outside said surrounding structure.

3. The apparatus of claim 1 further comprising an elastomeric member disposed between said cam member and said second sealing ring.

4. The apparatus of claim 1 wherein said cam surfaces and said cam ring are configured to cause said cylinder to retain its cylindrical configuration as it expands radially.

5. The apparatus of claim 1 wherein said segments are made of steel and are inelastic.

6. An apparatus for expanding and anchoring a tube within a surrounding structure by bulging one portion of the tube and flaring a tube end spaced therefrom to form a joint, said apparatus comprising:

an elongated support for insertion in said tube;

positioning means for axially positioning said support with respect to said surrounding structure;

first and second sealing rings encircling said support for engaging the inside surface of said tube and thus defining a hydraulic pressure zone extending axially through a portion of said tube, whereby hydraulic pressure applied within said zone causes radial expansion of said tube;

means for supplying pressurized hydraulic fluid through said support to said zone;

bulging means for expanding a portion of said tube outside said surrounding structure and adjacent to the surface of said structure, said bulging means comprising a first elastomeric ring at least partially disposed outside said surrounding structure, encircling said support within said tube and disposed on the side of said first seal ring opposite said zone, whereby hydraulic pressure within said zone causes axial compression and radial expansion of said first elastomeric ring; and flaring means for flaring an end portion of said tube that protrudes from said surrounding structure opposite said bulging means, said flaring means comprising a second elastomeric ring encircling said support within said surrounding structure and disposed on the side of said second sealing ring opposite said zone, a cylinder formed by a plurality of arcuate segments having cam surfaces thereon, and a cam member disposed between said cylinder and said second elastomeric ring, whereby hydraulic pressure within said zone causes said cylinder to expand radially thereby flaring said tube end.

7. The apparatus of claim 6 wherein said cylinder is located with respect to said positioning means so as to be disposed outside said surrounding structure.

8. The apparatus of claim 6 wherein said bulging means further comprising centering means for preventing angular movement of said first elastomeric ring relative to the longitudinal axis of said support.

9. The apparatus of claim 6 wherein said flaring means further comprises a resilient band encircling said cylinder.

10. The apparatus of claim 6 wherein:

said cam surface is conical; and said cam member is a ring having a conical spreader surface thereon that engages said cam surface.

11. The apparatus of claim 10 wherein said cam surface and said spreader surface each form an angle of about 15 degrees with the longitudinal axis of said support.

12. The apparatus of claim 6 wherein said cam surface and said cam ring are configured to cause said cylinder to retain its cylindrical configuration as said cylinder expands radially.

13. The apparatus of claim 6 wherein said first and second sealing rings are O-rings, said first and second elastomeric rings are polyurethane and said cylinder and said cam member are inelastic.

14. An apparatus for expanding and anchoring a tube within a surrounding structure by bulging one portion of the tube and flaring an opposite tube end to form a joint, said apparatus comprising:

an elongated support for insertion in said tube;

first and second sealing rings encircling said support for engaging the inside surface of said tube and thus defining a hydraulic pressure zone extending axially through a portion of said tube;

a passageway extending through said support to a location on the surface of said support between said sealing rings;

bulging means for expanding a portion of said tube outside said surrounding structure and adjacent to the surface of said structure, said bulging means comprising a first elastomeric ring encircling said support, at least partially disposed outside said surrounding structure, and positioned on the side of said first seal ring outside said zone, and a centering sleeve that is axially slidable on said support, said sleeve having a flange that extends radially outwardly between said first seal ring and said first elastomeric ring, whereby hydraulic pressure within said hydraulic pressure zone causes axial compression and radial expansion of said first elastomeric ring;

flaring means for flaring an end portion of said tube that protrudes from said surrounding structure opposite said bulging means, said flaring means comprising a second elastomeric ring encircling said support and disposed within said surrounding structure on the side of said second sealing ring opposite said hydraulic pressure zone, a cylinder formed by a plurality of separate arcuate segments having cam surfaces thereon, and a cam ring having a conical spreader surface thereon disposed between said cylinder and said second elastomic ring such that said spreader surface engages said cam surfaces, whereby hydraulic pressure within said zone causes radial expansion of said second elastomeric ring and radial expansion of said cylinder; and positioning means attached to said support for axially positioning said support relative to said surrounding structure.

15. The apparatus of claim 14 wherein said flaring means further comprises resilient means encircling said cylinder and urging said segments inwardly.

16. The apparatus of claim 14 wherein said segments define an external annular groove surrounding said cylinder, said flaring means further comprising a resilient band disposed within said groove and encircling said cylinder to urge said segments radially inwardly against said support.

17. The apparatus of claim 14 wherein said cam surfaces and said spreader surface each form an angle of about 15 degrees with said support.

18. The apparatus of claim 14 wherein said segments and said cam ring are configured to cause said cylinder to retain its cylindrical configuration as said cylinder expands radially in response to axial compression of said elastomeric ring.

19. The apparatus of claim 14 further comprising:

first and second circumferential grooves defined by said support in which said first and second sealing rings are normally disposed, respectively;

a seal-return spring urging said first sealing ring toward said first groove; and a cam-return spring urging said cam ring toward said pressure zone and urging said second sealing ring toward said second groove.

20. An apparatus for expanding and anchoring a tube within a tube sheet by bulging one portion of the tube and flaring a tube end spaced therefrom to form a joint, said apparatus comprising:

an elongated support for insertion in said tube, said support defining first and second circumferential grooves thereon;

first and second O-rings encircling said support for engaging the inside surface of said tube and thus defining a hydraulic pressure zone between them extending axially through a portion of said tube, said first and second O-rings being normally disposed within said first and second grooves, respectively;

a passageway extending through said support to a location on the surface of said support between said O-rings;

bulging means for expanding a portion of said tube outside said surrounding structure and adjacent to a surface of said structure, said bulging means comprising a first elastomeric polyurethane ring encircling said support and disposed outside said tube sheet on the side of said first O-ring opposite said zone, a sleeve that is axially slidable on said support, said sleeve having a flange that extends radially outwardly between said first O-ring and said first elastomeric ring, a spacer ring for retaining said first elastomeric ring and a nut threaded to said support to axially position first spacer ring, whereby hydraulic pressure within said zone causes axial compression and radial expansion of said first elastomeric ring;

a seal-return spring engaging said spacer ring, encircling said support and urging said first O-ring toward said first groove in opposition to pressure within said zone;

flaring means for flaring an end portion of said tube that protrudes from said surrounding structure opposite said bulging means, said flaring means comprising a second elastomeric polyurethane ring encircling said support and disposed within said tube sheet on the side of the said second O-ring opposite said hydraulic pressure zone, a plurality of inelastic arcuate steel segments directly adjacent to each other and arranged to form a cylinder surrounding said support outside said tube sheet, each of said segments having a conical cam surface thereon extending outwardly from said support and forming an angle of about 15 degrees with said support, said segments having serrations thereon and defining an external annular groove surrounding said cylinder, a resilient member disposed within said groove and encircling said cylinder, and an inelastic steel cam ring encircling and axially slidable on said support and disposed between said cylinder and said second elastomeric ring, said cam ring having a conical spreader surface thereon that mates with said cam surfaces of said segments, whereby hydraulic pressure within said zone causes radial expansion of said second elastomeric ring and said cylinder;

a cam-return spring arranged to urge said cam ring toward said pressure zone and to urge said second O-ring toward said second groove in opposition to pressure within said zone; and positioning means attached to said support for axially positioning said support such that said O-rings are disposed within said surrounding structure.

21. A method for expanding and anchoring a tube within a surrounding structure by flaring an end portion of said tube, said method comprising the steps of:

inserting said tube in a bore in said surrounding structure and positioning it so that said end portion protrudes;

positioning a swaging mandrel in said tube so that said mandrel defines an annular hydraulic pressure zone within said structure and so that an expandible cylinder formed by an array of arcuate segments is disposed within said end portion; and introducing a pressurized fluid into said zone, thus causing a cam member to move axially and thereby expand said cylinder radially to flair said end portion.

22. The method of claim 21 further comprising the step of compressing an elastomeric member axially in response to the pressure of said hydraulic fluid, said elastomeric member being disposed within said surrounding structure adjacent to said cylinder, whereby said cylinder prevents excessive deformation of said elastomeric member.

23. The method of claim 21 further comprising:

axially compressing a seal member that defines an end of said hydraulic pressure zone in response to the pressure of said hydraulic fluid; and axially compressing an elastomeric back-up member disposed within said surrounding structure and between said seal member and said cylinder, whereby said cylinder prevents excessive deformation of said elastomeric member.

24. A method for expanding and anchoring a tube within a surrounding structure by bulging said tube on one side of the surrounding structure and flaring an end of said tube projecting from the opposite side of said structure, said method comprising the steps of:

inserting said tube in a bore in said structure so that external portions of the tube extend from both sides of said surrounding structure;

positioning a swaging mandrel in said tube so that said mandrel defines an annular hydraulic pressure zone within said structure axially bound by first and second seal members, a first elastomeric member being disposed adjacent to said first seal member and at least partially outside said structure, and a second elastomeric member being disposed adjacent to said second seal member, and a cylinder formed by a plurality of arcuate segments being disposed adjacent to said second seal member, said cylinder being disposed outside said structure and in a projecting end of said tube; and introducing a pressurized fluid into said hydraulic pressure zone and thus (1) causing said tube to expand radially within said hydraulic pressure zone, (2) applying an axial compressive force to said first elastomeric member to exert a radial expansive force and cause said tube to bulge at one side of said structure, and (3) applying an axial compression force to said second elastomeric member thereby causing said second elastomeric member to exert a force on said cylinder, causing said cylinder to flare said projecting end of said tube, thereby interlocking said tube with said surrounding structure and insuring a tight visually verifiable leak proof joint extending to the surfaces of both sides of said surrounding structure.

* * * * *